US005946935A

United States Patent [19]

Ji

[11] Patent Number: 5,946,935

[45] Date of Patent: Sep. 7, 1999

[54] REFRIGERATOR WITH A DISCHARGE MEMBER FOR CHANGING A DISCHARGE POSITION OF COOL AIR

[75] Inventor: Joon Dong Ji, Suwon, Rep. of Korea

[73] Assignee: Samsung Electronics Co., Ltd., Suwon, Rep. of Korea

[21] Appl. No.: 09/132,900

[22] Filed: Aug. 12, 1998

[30] Foreign Application Priority Data

| | | | |
|---|---|---|---|
| Aug. 22, 1997 | [KR] | Rep. of Korea | 97-40252 |
| Aug. 22, 1997 | [KR] | Rep. of Korea | 97-40253 |
| Aug. 22, 1997 | [KR] | Rep. of Korea | 97-40254 |

[51] Int. Cl.[6] ..... F25D 17/08

[52] U.S. Cl. ..... 62/408; 62/186; 62/407

[58] Field of Search ..... 62/186, 407, 408

[56] References Cited

U.S. PATENT DOCUMENTS

| | | | |
|---|---|---|---|
| 4,539,819 | 9/1985 | Alba | 62/78 |
| 4,671,078 | 6/1987 | Pink | 62/408 |

FOREIGN PATENT DOCUMENTS

| | | | |
|---|---|---|---|
| 0144536 | 7/1985 | Japan | 62/186 |
| 406109354 | 4/1994 | Japan | 62/408 |

*Primary Examiner*—Henry Bennett
*Assistant Examiner*—Melvin Jones
*Attorney, Agent, or Firm*—Burns, Doane, Swecker & Mathis, L.L.P.

[57] ABSTRACT

Disclosed is a refrigerator having a discharge member for changing a discharge position of cool air. A duct plate for forming a cool air duct is installed on a side wall of a cooling compartment. The duct plate has an opening part opened into the compartment. The discharge member is installed on the duct plate. The discharge member closes the opening part, and has a discharge pipe for discharging cool air flowing into the cool air duct toward the compartment. The discharge member is supported by a guide part to be capable of sliding vertically or horizontally. The position of the discharge member is controlled by a driving device. Thus, the cool air can be uniformly distributed vertically and horizontally, or can be concentrated on a specific area. Further, the amount of frost which may be generated by a backflow of cool air is reduced.

12 Claims, 18 Drawing Sheets

REFRIGERATOR WITH A DISCHARGE MEMBER FOR CHANGING A DISCHARGE POSITION OF COOL AIR

BACKGROUND OF THE INVENTION

1. Field of the Invention

The present invention relates to a refrigerator, and more particularly, to a refrigerator having a discharge member for changing a discharge direction of cool air discharged into a cooling compartment.

2. Prior Art

In general, a refrigerator has a cabinet for forming a pair of cooling compartments, i.e., a freezing compartment and a fresh food compartment which are partitioned by a partitioning wall, a freezing compartment door and a fresh food compartment door for opening/closing the cooling compartments respectively, and a cooling system for supplying the freezing compartment and the fresh food compartment with cool air, which is comprised of a compressor, a condenser and an evaporator. The cool air generated by the evaporator flows along a supply duct formed in a rear wall of each compartment, and then is supplied into each cooling compartment by a blowing fan through cool air discharge ports opened thereinto.

In such a conventional refrigerator, however, there exist an area on which the cool air discharged through the cool air discharge ports is concentrated, and an area to which a relatively small amount of cool air is supplied, so there occurs a deviation of temperature in the cooling compartments and uniform cooling cannot be achieved. Therefore, the refrigerator adopting so called tri-dimensional cooling method which has amended such a problem has been proposed. In the refrigerator adopting the tri-dimensional cooling method, the cool air discharge ports are provided at both side walls as well as at the rear wall of the cooling compartment in order to promote the uniform cooling.

However, in such a refrigerator adopting the tri-dimensional cooling method, since the cool air is discharged through the cool air discharge ports in fixed directions, there may be a dead-zone at an edge area which is not supplied with the cool air sufficiently. In particular, since the supply duct has to be provided not only in the rear wall but also in the side walls, there are problems that the space for storing food is reduced and the manufacturing cost increases due to the increased number of components and processes.

The uniform distribution of cool air has risen to an important problem in relation to the trend of using large-sized refrigerators.

In consideration of such a problem, the applicant of this invention has proposed a refrigerator having a device for dispersing cool air in International Patent Application WO 95/27278. FIGS. 1 through 3 are a side view, a partial enlarged sectional view, and an exploded perspective view of main elements of the refrigerator having the device for dispersing cool air.

The conventional refrigerator having the device for dispersing cool air has a pair of cooling components 2 and 3 in a cabinet 1, which are partitioned from each other by a partitioning wall 5. The cooling components 2 and 3 are called a freezing compartment 2 of relatively low temperature and a fresh food compartment 3 of relatively high temperature. On the front opening of the cooling compartments 2 and 3, doors 6 and 7 for opening/closing them are installed respectively. In the cabinet 1 is installed a cooling system comprising a compressor 11, a condenser (not shown), a freezing compartment evaporator 12*a*, and a fresh food compartment evaporator 12*b*. The cool air generated from the evaporators 12*a* and 12*b* is supplied to the corresponding compartments 2 and 3 by a freezing compartment fan 13*a* and a fresh food compartment fan 13*b* respectively.

A duct plate 9 of partial cylinder shape having cool air discharge ports 16 opened to the fresh food compartment 3 is attached to an inner wall plate 23 forming a rear inner wall surface of the fresh food compartment 3, and a supply duct 15 and a return duct 17 separated from each other by a seal plate 25 are provided between the duct plate 9 and a rear wall 4 of the cabinet 1. In the supply duct 15 is installed a duct member 21 for guiding the cool air blown by the fresh food compartment fan 13*b* downwardly. The cool air generated by the fresh food compartment evaporator 12*b* is blown by the fresh food compartment fan 13*b*, and then supplied to the fresh food compartment 3 via the supply duct 15 and the cool air discharge ports 16.

A cool air dispersing device 130 is installed in the supply duct 15. The cool air dispersing device 130 is comprised of a rotational shaft 131 having a vertical axis, cool air dispensing blades 132 assembled with the rotational shaft 131 at areas corresponding to the cool air discharge ports 16 respectively, and a driving motor 135 for rotating the rotational shaft 131. Each of the cool air dispersing blades 132 is comprised of three discs 136, 137 and 138 disposed in parallel with each other along the axis direction, and a first blade part 133 and a second blade part 134 disposed between the discs 136, 137 and 138. Each of the blade parts 133 and 134 are bent so that their cross section is a lax shape of alphabet S. The blade parts 133 and 134 are bent to the opposite directions to each other.

In the refrigerator having the above-described construction, when the driving motor 135 rotates the rotational shaft 131 at a low speed, the cool air flowing along the supply duct 15 changes its flowing direction along the bent surface of the cool air dispersing blades 132, and is discharged into the fresh food compartment 3 to be dispersed horizontally. Meanwhile, when the concentrative cooling on a specific area is needed, the driving motor 135 stops the rotational shaft 131 in accordance with the direction of the cool air dispersing blades 132 so that the cool air is concentrated on the specific area.

However, in such a conventional refrigerator, the construction of the cool air dispersing device 130 is complex, so it is hard to manufacture it, and manufacturing cost increases.

Furthermore, since the cool air discharge ports 16 are in open state always, air in the fresh food compartment evaporation 12*b* may flow back into the supply duct 15 through the cool air discharge ports 16. Since the temperature of the air in the fresh food compartment 3 is relatively high, frost may be generated on the fresh food compartment evaporator 12*b* by the air flowing back. The frost on the evaporator 12*b* causes the lowering of cooling efficiency of the refrigerator.

Moreover, according to the conventional cool air dispersing device 130, uniform distribution of cool air can be achieved in a horizontal direction, however, it cannot be achieved in a vertical direction since the cool air is not dispersed vertically. Thus, the temperature difference between the upper and lower areas of the fresh food compartment 3 may occur. Furthermore, even when a user wants to cool the food on a specific area in the fresh food compartment 3, the discharge direction of cool air cannot be changed arbitrarily.

SUMMARY OF THE INVENTION

The present invention has been proposed to overcome the above-described problems in the prior art, and accordingly it is the object of the present invention to provide a refrigerator which is simple and capable of preventing backflow of cool air in a cooling compartment toward an evaporator.

Another object of the present invention is to provide a refrigerator which is capable of dispersing cool air uniformly in vertical and horizontal directions, and changing a discharge direction of cool air arbitrarily.

To achieve the above objects, the present invention provides a refrigerator comprising: a duct plate for forming a cool air duct in a side wall of said cooling compartment, said duct plate having an opening part opened into said cooling compartment; a discharge member being installed on said duct plate so as to close said opening part, said discharge member having a discharge pipe for discharging cool air flowing into said cool air duct toward said cooling compartment; and a means for supporting said discharge member so that a position of said discharge pipe can be changed.

The supporting means comprises a guide part having recesses for receiving edges of said discharge member to be capable of sliding.

The recesses are formed vertically and/or horizontally. Thus, said discharge member is capable of sliding vertically and/or horizontally.

Preferably, said recesses are bent to be arc-shaped, and said discharge member has a shape of a plate which is bent so as to correspond to said recesses which are bent. Accordingly, an angular position of said discharge pipe can be controlled.

According to a preferred embodiment of the present invention, the discharge member is driven by a driving means so that the position of said discharge pipe is changed. Here, said driving means comprises: a motor; a rotational shaft being rotated by said motor; and a means for converting a rotational movement of said rotational shaft to an elevational/de-elevational movement of said discharge member.

It is preferable that said motor is a stepping motor capable of controlling a stop angular position thereof.

According to the present invention, a refrigerator is provided which is simple and capable of preventing backflow of air from a cooling compartment to an evaporator. Furthermore, uniform distribution of cool air can be achieved in horizontal and vertical directions, and concentrative cooling of a specific area can be performed.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Figure 1:
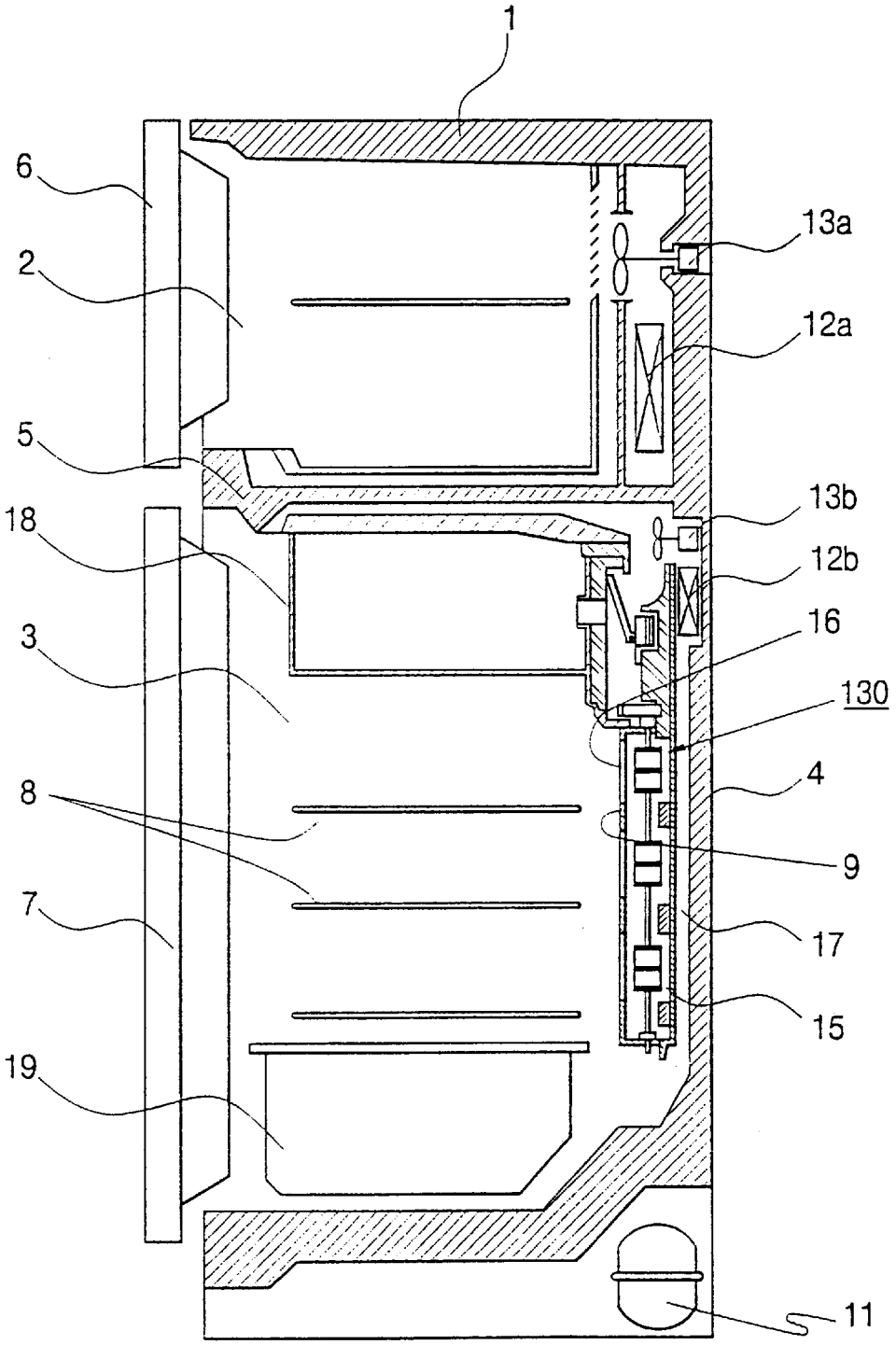
FIG. 1 (PRIOR ART)
FIG. 1 is a side sectional view of a conventional refrigerator having cool air dispersing blades.
Figure 2:
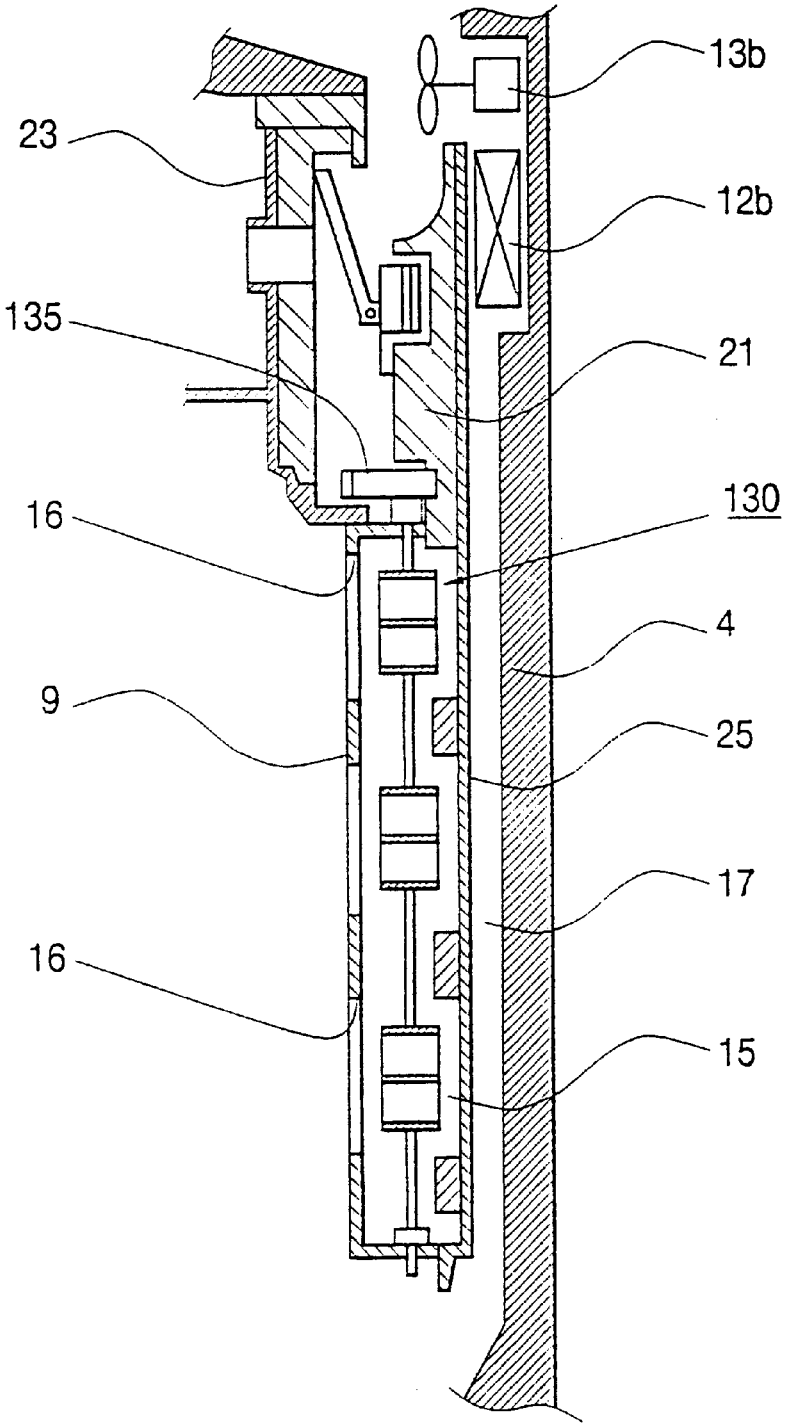
FIG. 2 (PRIOR ART)
FIG. 2 is a partial enlarged sectional view of FIG. 1.
Figure 3:
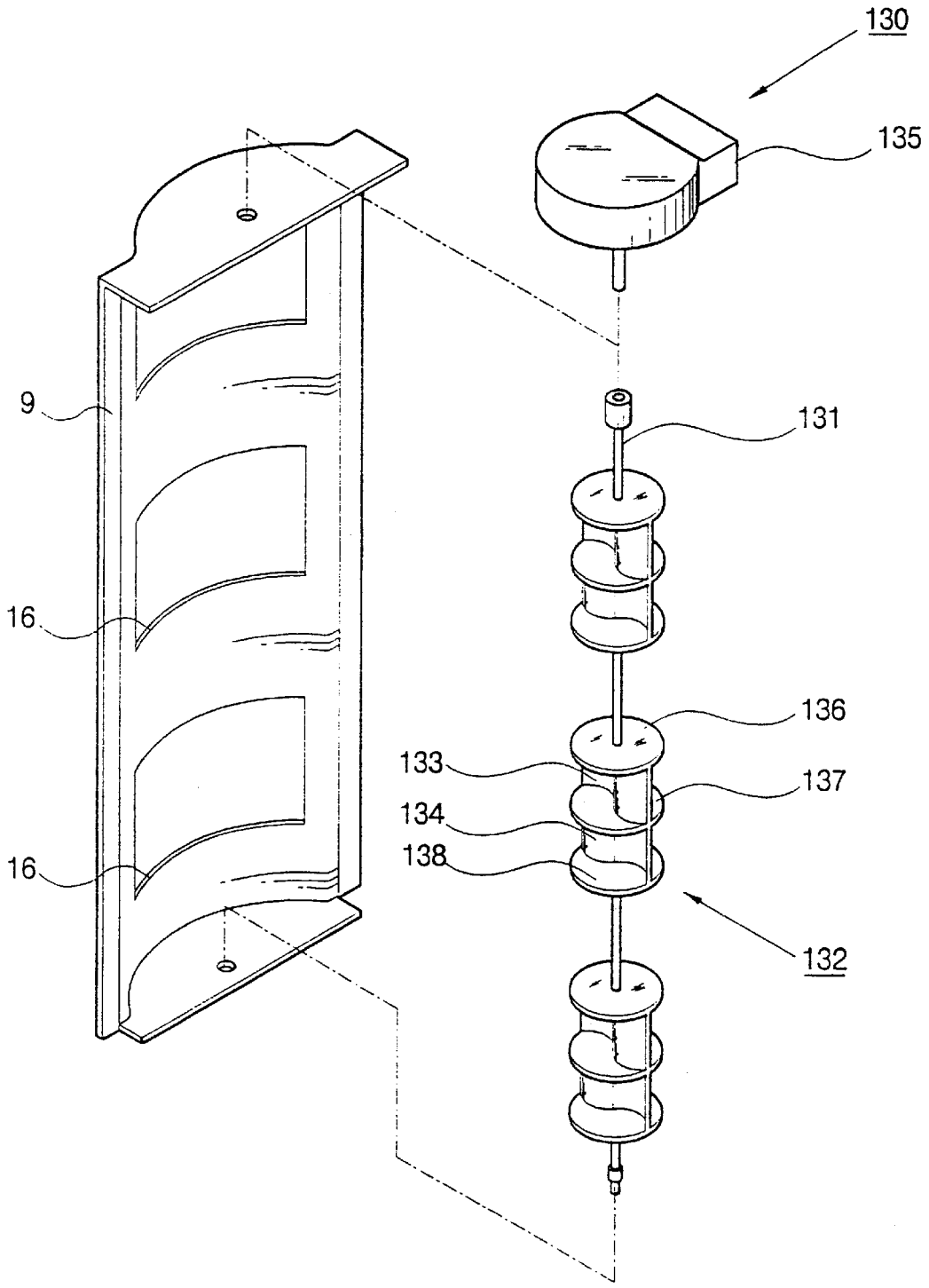
FIG. 3 (PRIOR ART)
FIG. 3 is an enlarged exploded perspective view of main elements of FIG. 2.

Hereinafter, the present invention will be described in detail with reference to the drawings. Parts identical to those in the conventional refrigerator shown in FIGS. 1 through 3 will be referred to with the same reference numerals. The description of the parts in each embodiment which are substantially the same with the parts of the prior art will be omitted.

Figure 4:
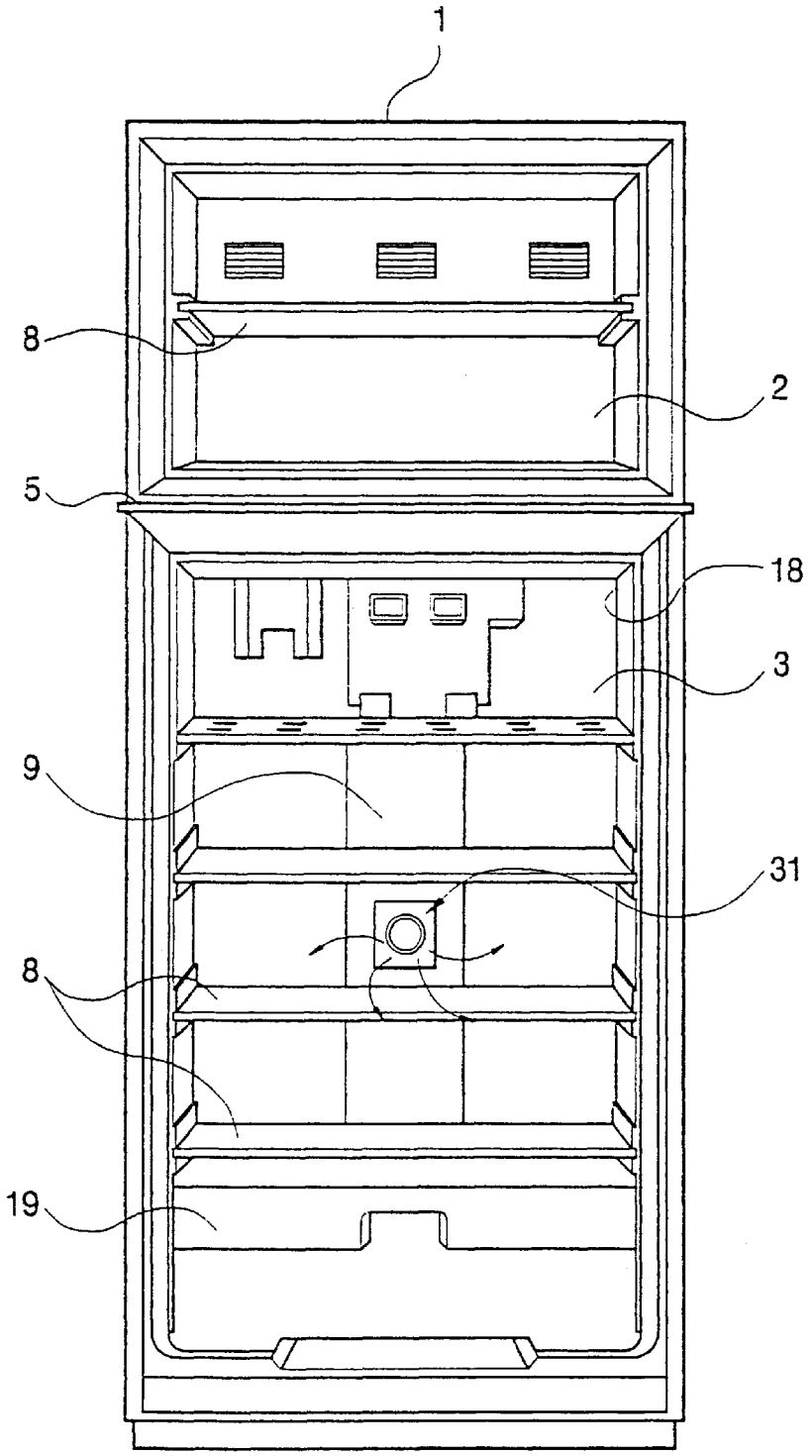
FIG. 4 is a front view of a refrigerator according to the first embodiment of the present invention.
Figure 5:
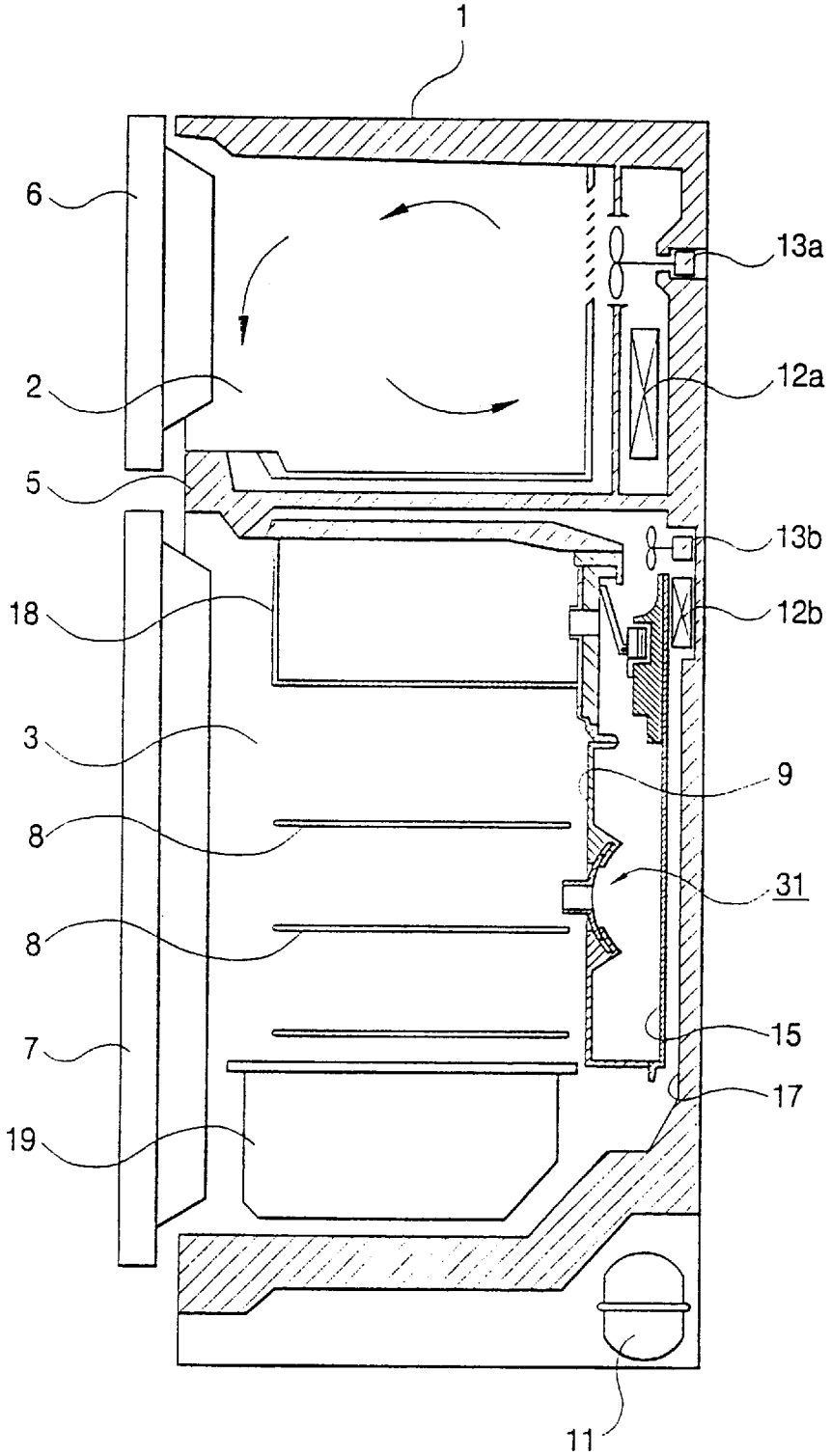
FIG. 5 is a side sectional view of FIG. 4.

FIG. 4 is a front view of a refrigerator according to the first embodiment of the present invention, and FIG. 5 is a side sectional view of FIG. 4. The refrigerator has, as the conventional refrigerator which has been illustrated with reference to FIGS. 1 through 3, a cabinet 1 forming freezing compartment 2 and a fresh food compartment which are partitioned by a partitioning wall 5 and are disposed upper and lower parts thereof, respectively. On the front openings of the freezing compartment 2 and the fresh food compartment 3, doors 6 and 7 for opening/closing them are installed respectively. In the fresh food compartment 3, shelves 8 for placing food thereon is installed, which divide the fresh food compartment 3 into three stratified area, i.e., an upper area, a middle area, and a lower area. A special fresh chamber 18 for storing food which are proper to a specific temperature range is formed at the upper part of the fresh food compartment 3, and a vegetable chamber 19 for storing vegetables is formed at the lower part of the fresh food compartment 3.

In the cabinet 1 is installed a cooling system comprising a compressor 11, a condenser (not shown), a freezing compartment evaporator 12*a*, and a fresh food compartment evaporator 12*b*. The cool air generated by the evaporators 12*a* and 12*b* is supplied into the corresponding cooling compartments 2 and 3 by the freezing compartment fan 13*a* and the fresh food compartment fan 13*b*.

A supply duct 15 and a return duct 17 are provided in the rear of the fresh food compartment 3. The supply duct 15 is formed by a duct plate 9 installed on the rear wall 4 of the fresh food compartment 3. At the central area of the duct plate 9 is formed an opening part 26 opened toward the inside of the fresh food compartment 3.

Figure 6:
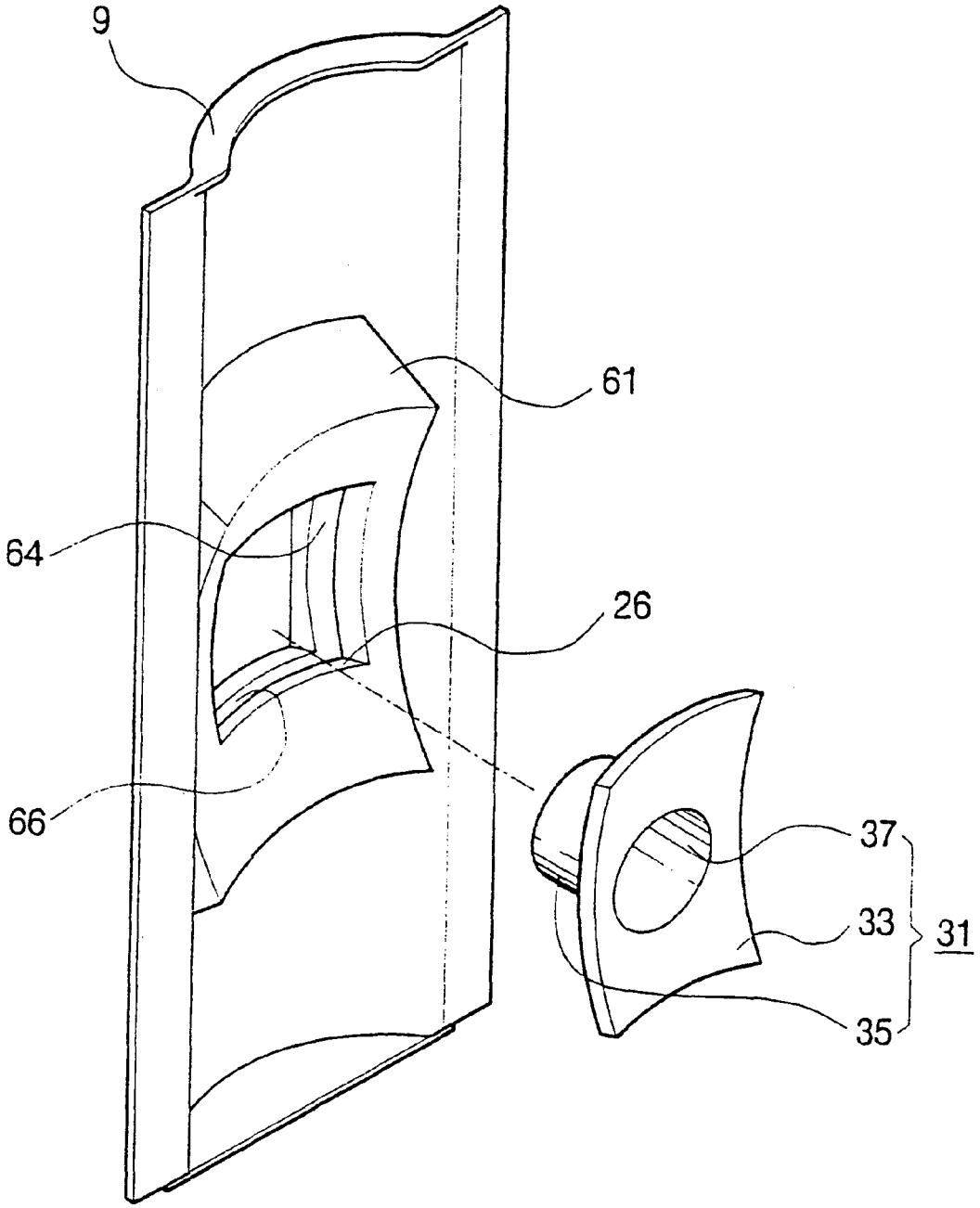
FIG. 6 is a partial enlarged exploded perspective view of FIG. 5.
Figure 7:
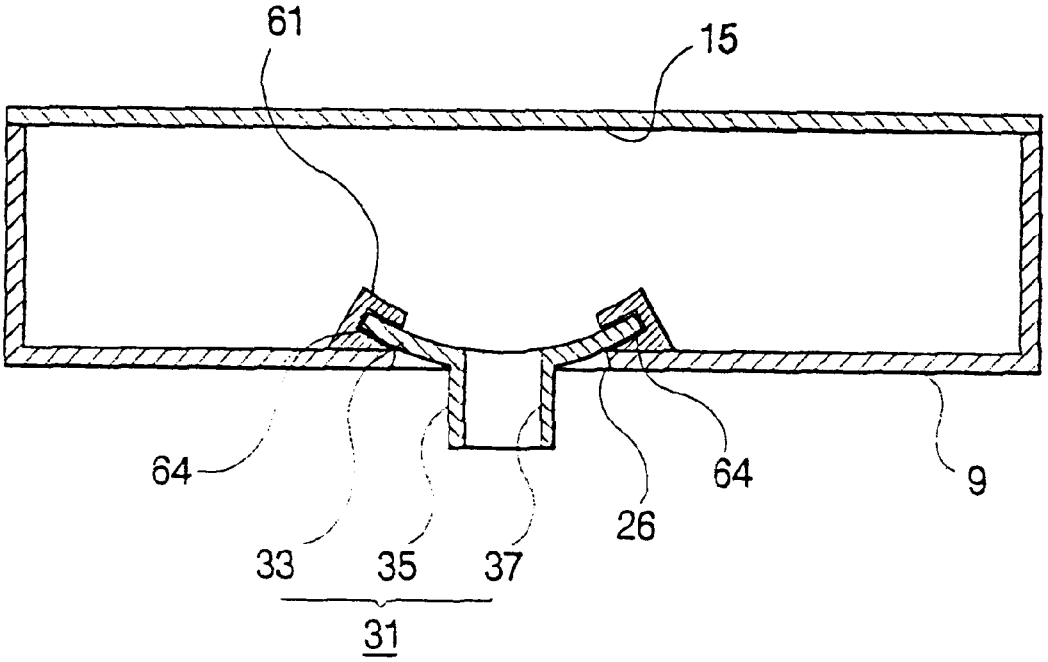
FIG. 7 is a transverse sectional view of the assembled state of FIG. 6.

FIG. 6 is a partial enlarged exploded perspective view of FIGS. 5, FIG. 7 is a transverse sectional view of the assembled state of FIG. 6, and FIGS. 8 through 10 are side sectional views of the assembled state of FIG. 6.

A discharge member 31 is installed on the rear side of the duct plate 9. The discharge member 31 is comprised of a plate 33 and a discharge pipe 35. The plate 33 closes the opening part 26 of the duct plate 9. The discharge pipe 35 provides a cool air passage 37 for discharging the cool air flowing into the supply duct 15 toward the fresh food compartment 3.

The discharge member 31 is supported by a guide part 61. The central area of the guide part 61 is open so as to correspond to the opening part 26 of the duct plate 9. On both of the side surfaces of the guide part 61 are formed vertical recesses 64, and on the upper and lower surfaces thereof are formed horizontal recesses 66. The vertical and horizontal recesses 64 and 66 receive both of the side edges, the upper edge, and the lower edge of the plate 33, respectively.

The horizontal recesses 66 have depths enough to allow the vertical movement of the plate 33, whereby the plate 33 can move vertically. The vertical recesses 64 have depths corresponding to the width of the plate 33, whereby the plate 33 cannot move horizontally. Accordingly, the vertical sliding of the plate 33 is guided by the vertical recesses 64. When the plate 33 is elevated along the vertical recesses 64, the discharge pipe 35 is positioned at the upper area of the opening part 26. Further, when the plate 33 is de-elevated along the vertical recesses 64, the discharge pipe 35 is positioned at the lower area of the opening part 26.

Figure 8:
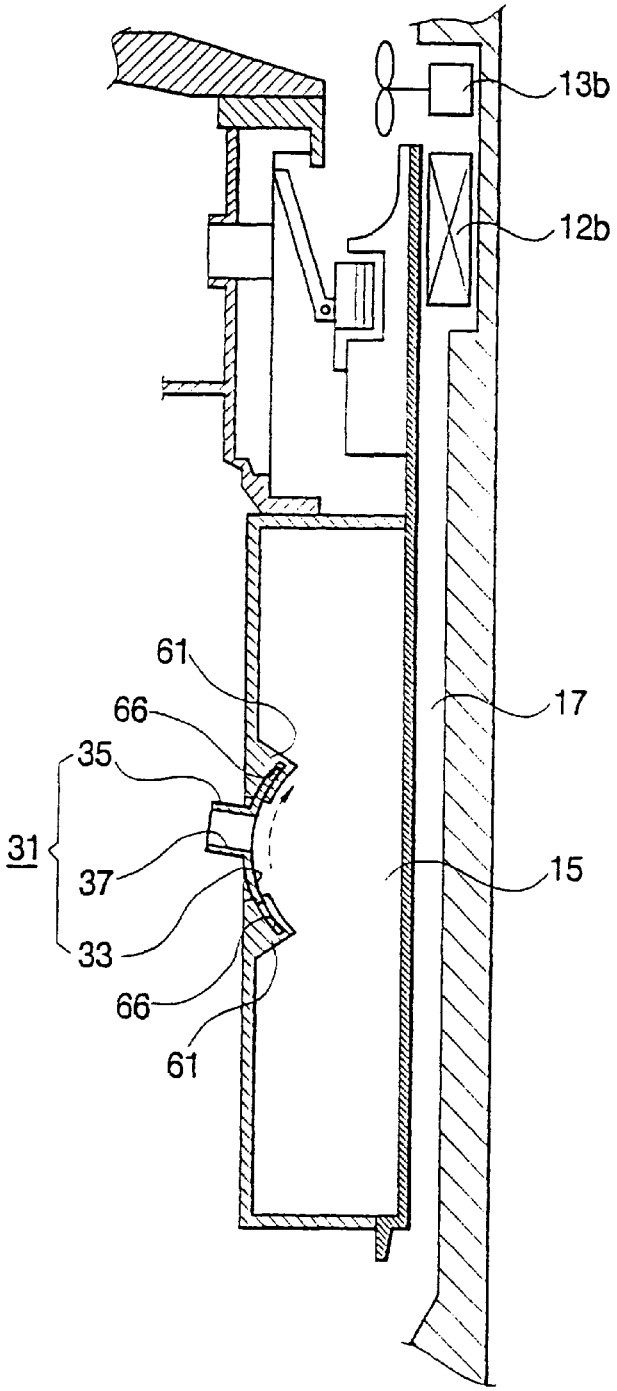
FIGS. 8 through 10 are side sectional views of the assembled state of FIG. 6.
Figure 10:
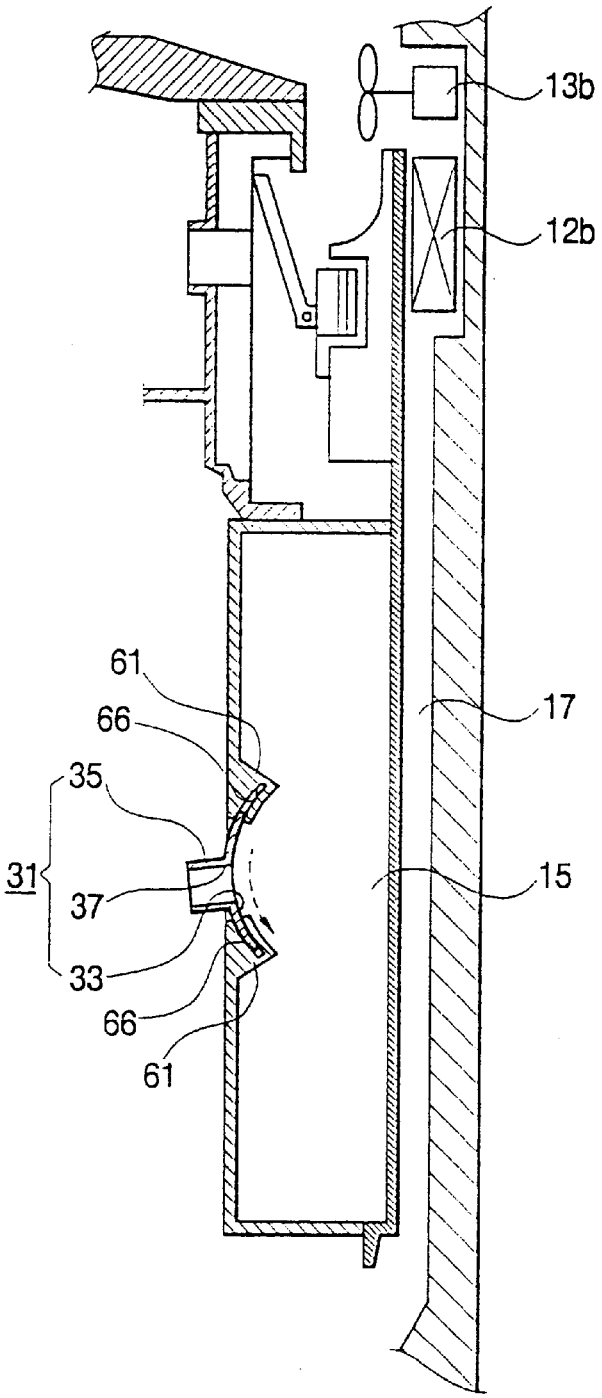

The vertical recesses 64 are bent to be arc-shaped, and the plate 33 of the discharge member 31 is bent so as to correspond to the bent vertical recesses 64. Thus, while the plate 33 is elevated, the discharge pipe 35 is tilted upward as shown in FIG. 8, and while the plate 33 is de-elevated, the discharge pipe 35 is tilted downward as shown in FIG. 10.

Hereinbelow, the operation of the cool air dispersing device according to the first embodiment of the present invention having the above-described construction will be described.

Figure 9:
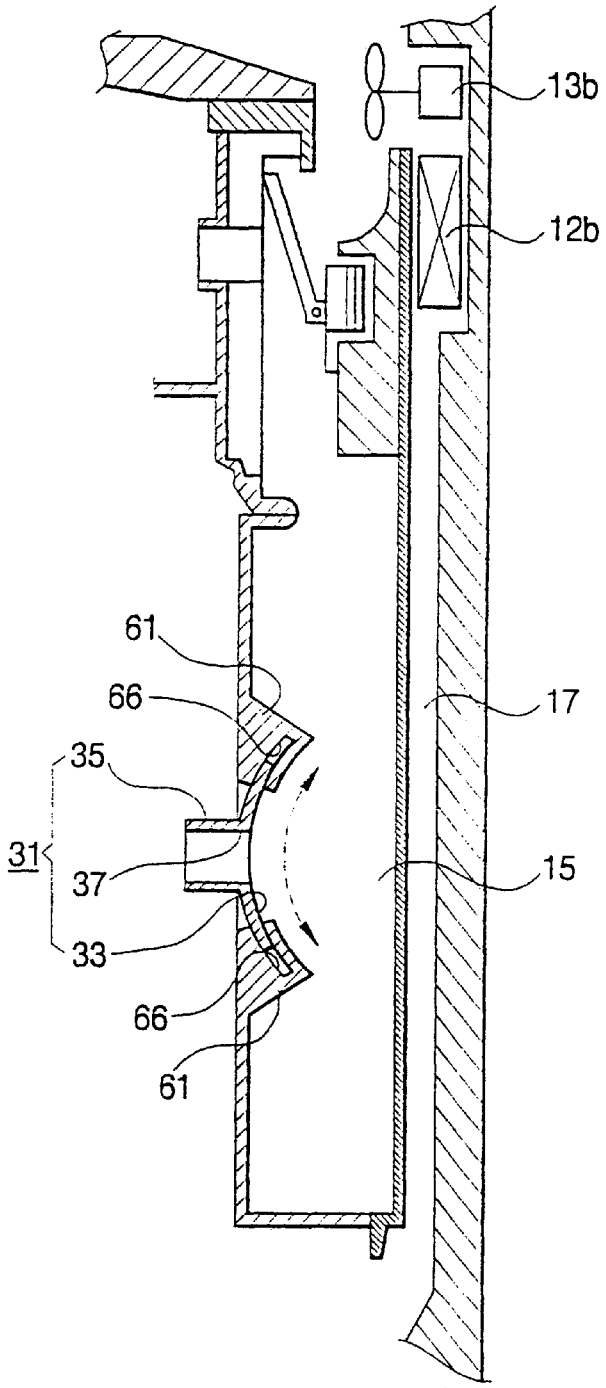

The cool air generated by the fresh food compartment evaporator 12*b* is blown into the supply duct 15 by the fresh food compartment fan 13*b*. The cool air supplied into the supply duct 15 is then supplied into the fresh food compartment 3 through the discharge pipe 35. In such a situation, the position and direction of the discharged cool air are determined by the position of the discharge member 31. In other words, when a user elevates the discharge member 3 manually, the cool air is discharged toward the upper area of the fresh food compartment 3 by the discharge pipe 35 which is positioned at the upper area of the opening part 26 and tilted upward as shown in FIG. 8. Similarly, if the user positions the discharge member 31 on a middle position as shown in FIG. 9, the cool air is discharged toward the central area of the fresh food compartment 3, and if the user de-elevates the discharge member 31 as shown in FIG. 10, the cool air is discharged toward the lower area of the fresh food compartment 3.

According to the present embodiment, the user can change the vertical position of the discharge member 31 manually so that the part on which the cool air is concentrated can be controlled. Accordingly, the uniform distribution of cool air in vertical direction can be achieved, and a specific area can be cooled easily.

Furthermore, according to the present embodiment, the cool air can be dispersed by the discharge member 31 having a simple construction. Thus, it can be manufactured easily, and manufacturing cost deceases.

Moreover, according to the present embodiment, since the opening part 26 is closed by the plate 33 of the discharge member 31, the amount of air flowing back from the fresh food compartment 3 toward the evaporator 12*b* is reduced. Therefore, the amount of frost generated on the evaporator 12*b* is reduced, and cooling efficiency increases.

Figure 11:
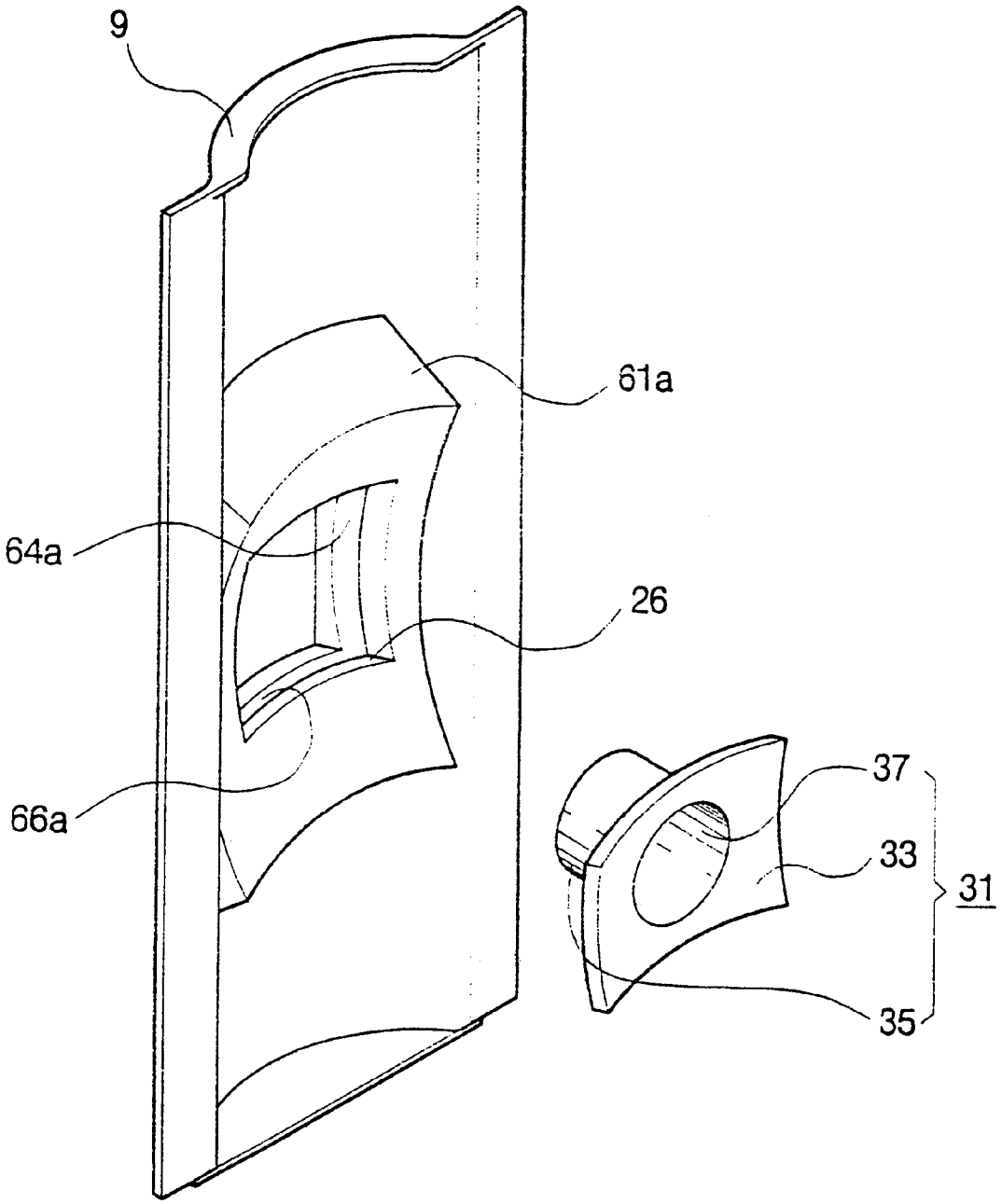
FIG. 11 is an exploded perspective view of a cool air dispersing device according to the second embodiment of the present invention.
Figure 12:
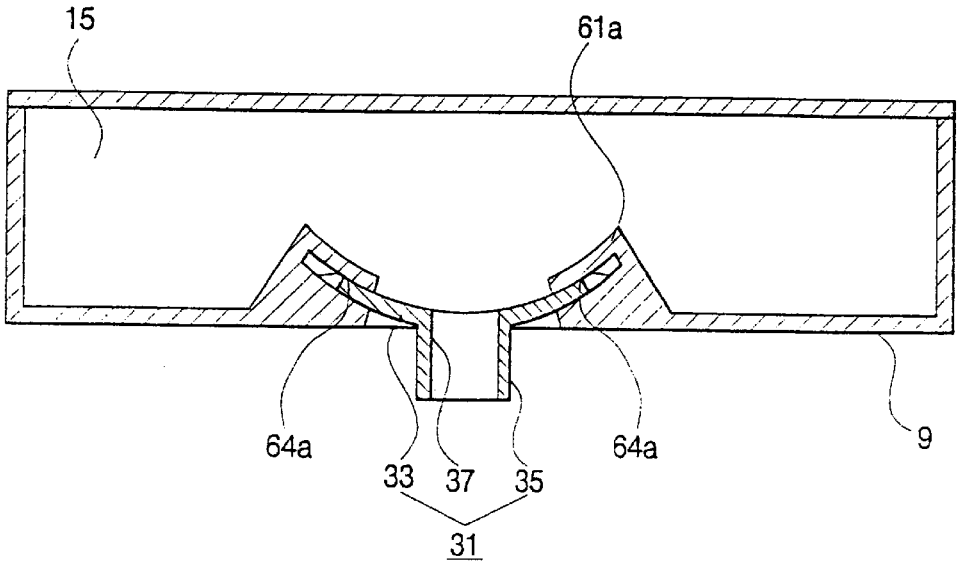
FIGS. 12 through 14 are transverse sectional views of the assembled state of FIG. 11.
Figure 13:
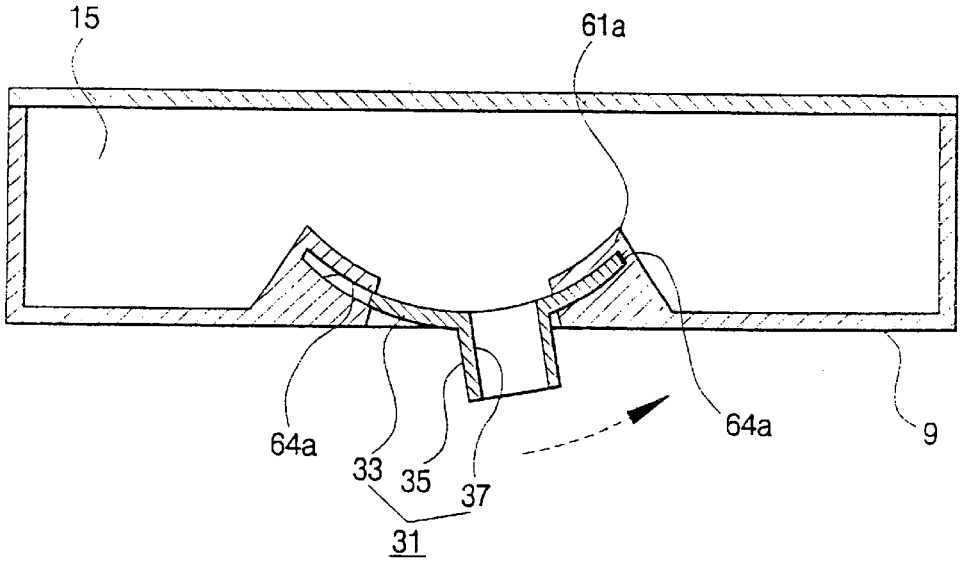
Figure 14:
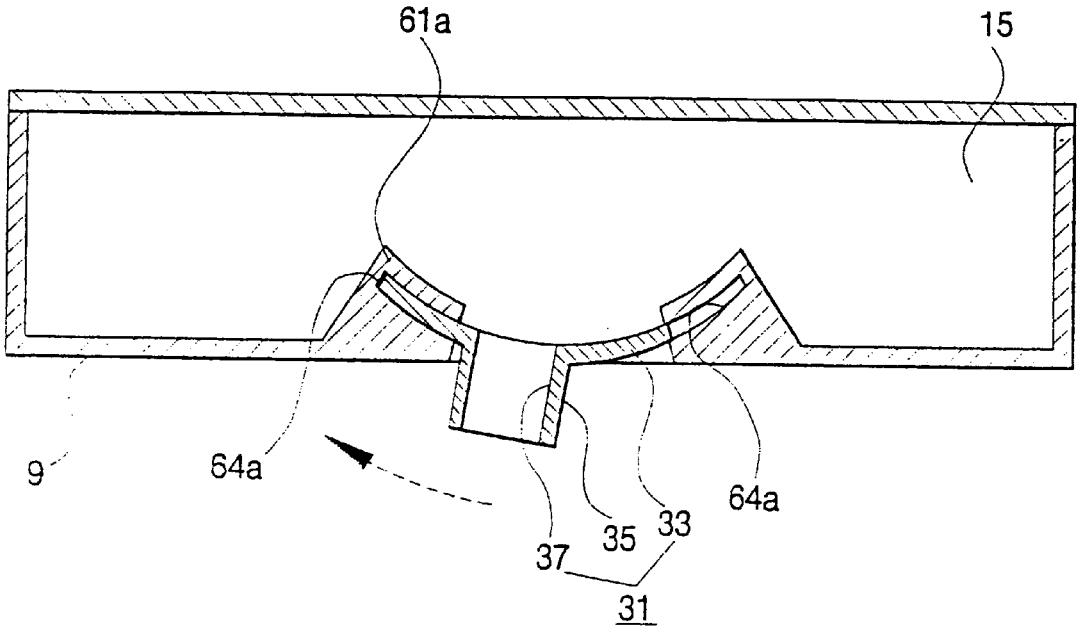

FIG. 11 is an exploded perspective view of a cool air dispersing device according to the second embodiment of the present invention, and FIGS. 12 through 14 are transverse sectional views of the assembled state of FIG. 11. In the description of following embodiments, the parts identical to those in the first embodiment are not described, and are referred to with the same reference numerals. In the present embodiment, the construction of the duct plate 9 is identical to that of the aforementioned first embodiment. Further, the discharge member 31 has, as described above, a plate 33, and a discharge pipe 33 for forming a cool air passage 37. On the rear side of the duct plate 9 is installed a guide part 61*a* for supporting the discharge member 31. The guide part 61*a* has, as described above, vertical recesses 64*a* and horizontal recesses 66*a*. In the present embodiment, however, the depths of the vertical recesses 64*a* and the horizontal recesses 66*a* are different from those of the vertical and horizontal recesses 64 and 66 shown in the above-described first embodiment.

Describing in detail, the vertical recesses 64*a* have depths enough to allow the horizontal movement of the plate 33, whereby the plate 33 can move horizontally. The horizontal recesses 66*a* have depths corresponding to the height of the plate 33, whereby the plate 33 cannot move vertically. Accordingly, the horizontal sliding of the plate 33 is guided by the horizontal recesses 66*a*. When the plate 33 is moved right along the horizontal recesses 66*a*, the discharge pipe 35 is positioned at the right area of the opening part 26. Further, when the plate 33 is moved left along the horizontal recesses 66*a*, the discharge pipe 35 is positioned at the left area of the opening part 26.

The horizontal recesses 66*a* are bent to be arc-shaped, and the plate 33 of the discharge member 31 is bent so as to correspond to the bent horizontal recesses 66*a*. Thus, while the plate 33 is moved right, the discharge pipe 35 is tilted rightward as shown in FIG. 13, and while the plate 33 is moved left, the discharge pipe 35 is tilted leftward as shown in FIG. 14.

Accordingly, when a user moves the discharge member 3 manually to the right or left, the cool air is discharged toward the right or the left area of the fresh food compartment 3 as shown in FIGS. 13 and 14. Similarly, if the user positions the discharge member 31 on a middle position as shown in FIG. 12, the cool air is discharged toward the central area of the fresh food compartment 3.

According to the present embodiment, the user can change the horizontal position of the discharge member 31 manually so that the part on which the cool air is concentrated can be controlled. Therefore, uniform distribution of cool air in horizontal direction can be achieved, and a specific area can be cooled easily.

Furthermore, the present embodiment also has the advantages that the construction is simple, the manufacturing cost decreases, and the frost is reduced.

Figure 15:
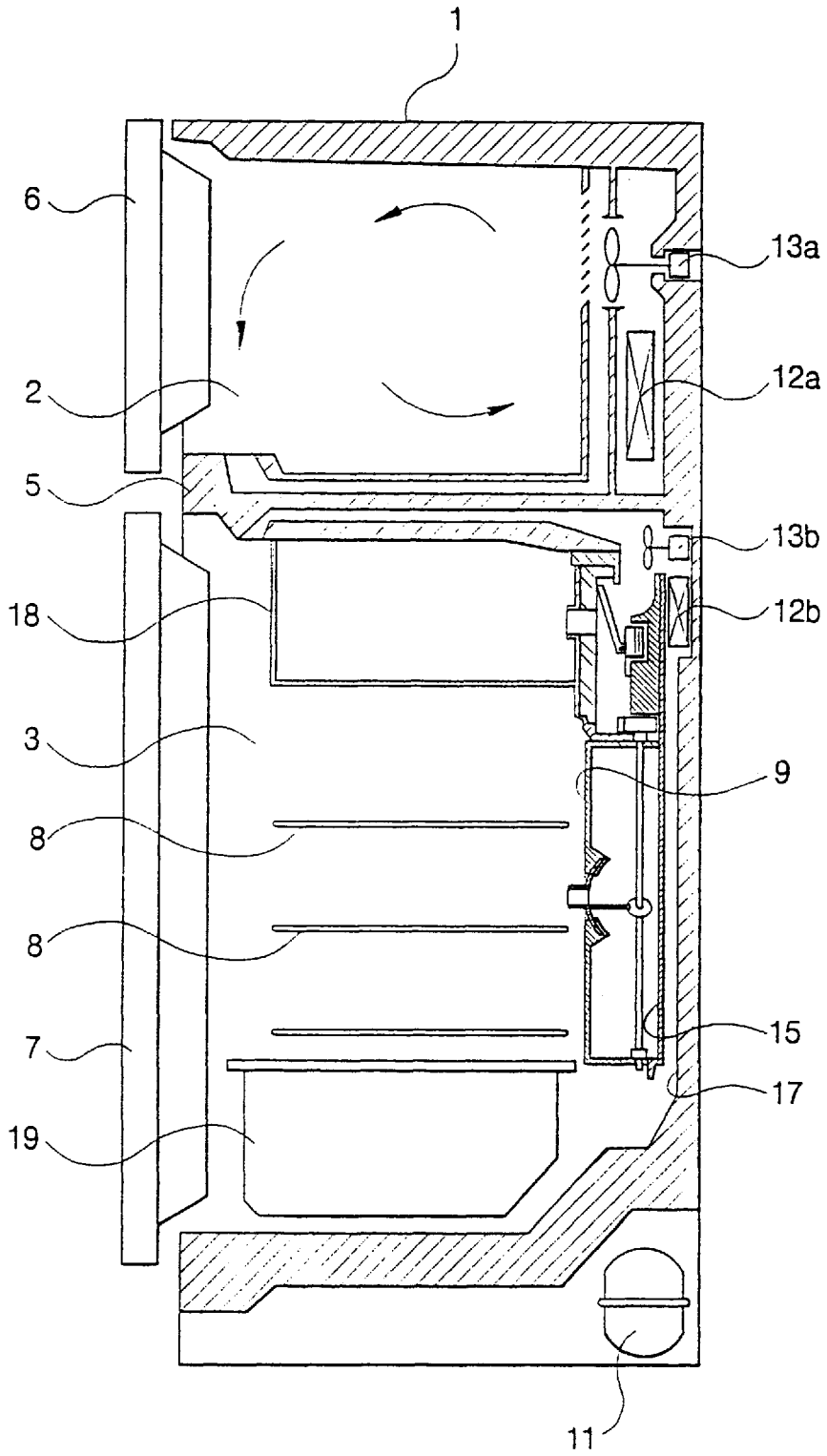
FIG. 15 is a side sectional view of the refrigerator according to the third embodiment of the present invention.
Figure 16:
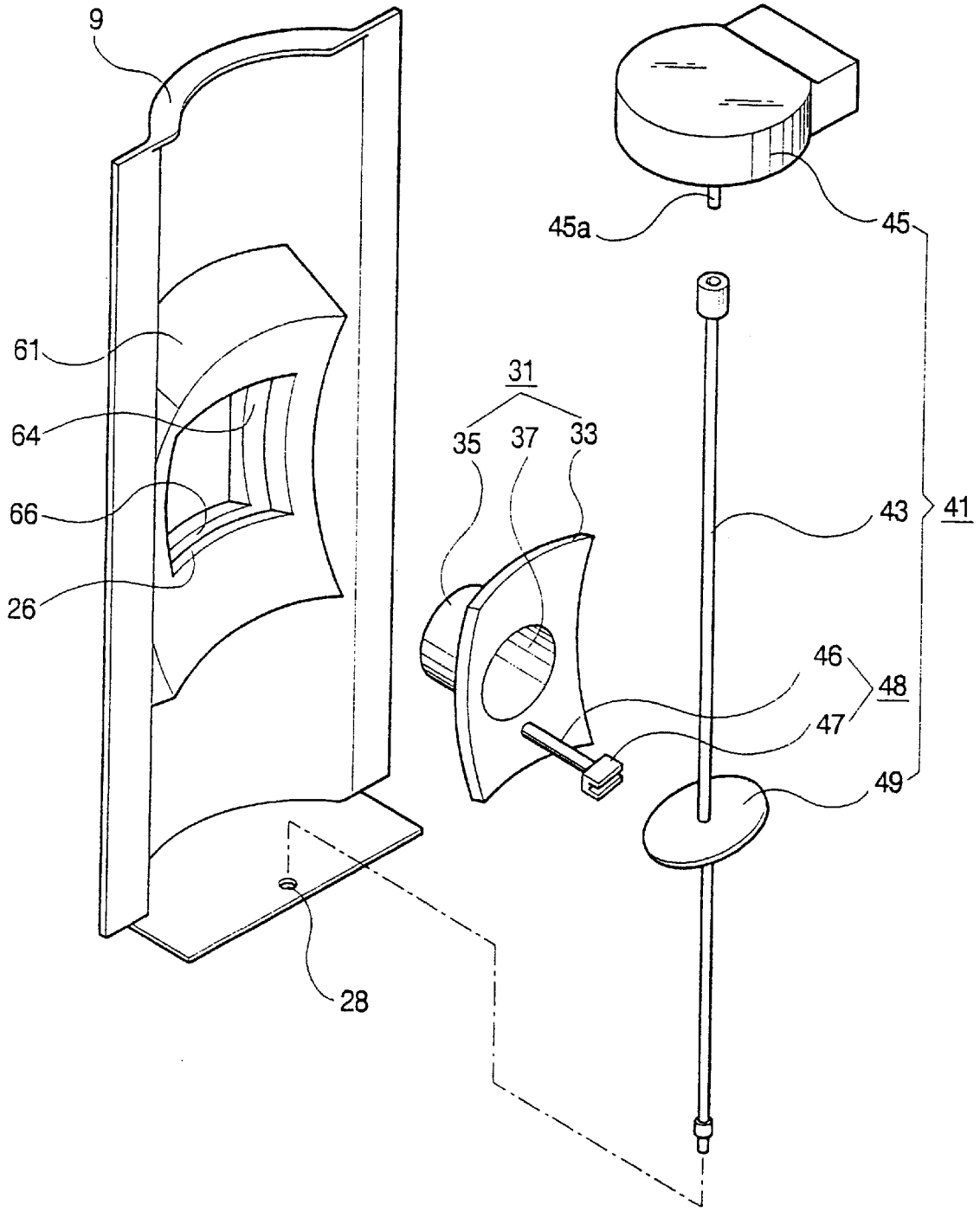
FIG. 16 is a partial enlarged exploded perspective view of FIG. 15.

FIG. 15 is a side sectional view of the refrigerator according to the third embodiment of the present invention, FIG. 16 is a partial enlarged exploded perspective view of FIG. 15, and FIGS. 17 through 19 are side sectional views of the assembled state of FIG. 16.

In the present embodiment, the constructions of the duct plate 9, the discharge member 31, and the guide part 61 are identical to those in the aforementioned first embodiment. That is, the discharge member 31 has, as described above, a plate 33, and a discharge pipe 33, and the guide part 61 is installed on the rear side of the duct plate 9. The guide part 61 has, as described in the description of the first embodiment, vertical recesses 64 and horizontal recesses 66. The discharge member 61 is capable of sliding vertically along the vertical recesses 64 just like that in the first embodiment. Furthermore, the vertical recesses 64 and the plate 33 are bent to be arc-shaped so that the angular position of the discharge pipe 35 is changed when the discharge member 61 is moved up and down. In the present embodiment, however, the refrigerator further comprises a driving device 41 for driving the discharge member 31.

The driving device 41 comprises a motor 45, a rotational shaft 43, a cam 49, and an operation part 48.

The rotational shaft 43 is disposed vertically, and the upper end thereof is coupled with the shaft 45*a* of the motor 45. The lower end of the rotational shaft 43 is inserted into a supporting hole 28 provided at the lower part of the duct plate 9. Thus, the rotational shaft 43 is supported by the supporting hole 28 to be capable of rotating.

The cam 49 is installed on the rotational shaft 43 coaxially therewith. The cam 49 is a disc tilted at a predetermined angle against the rotational shaft 43.

The operation part 48 is comprised of a rod protruding from the discharge member 31, and an assembly part 47 formed at the end of the rod 46. The assembly part 47 receives the edge of the cam 49, whereby the assembly part 47 and the cam 49 are engaged with each other.

Figure 17:
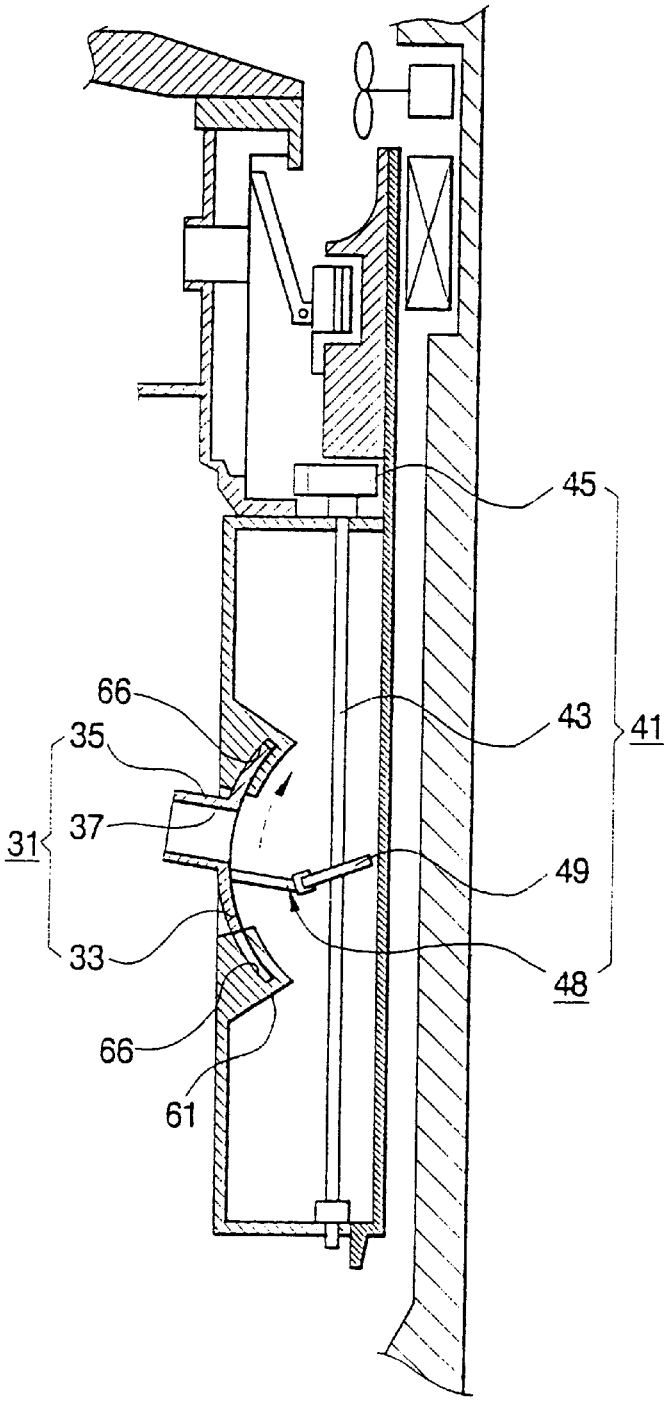
FIGS. 17 through 19 are side sectional views of the assembled state of FIG. 16.
Figure 18:
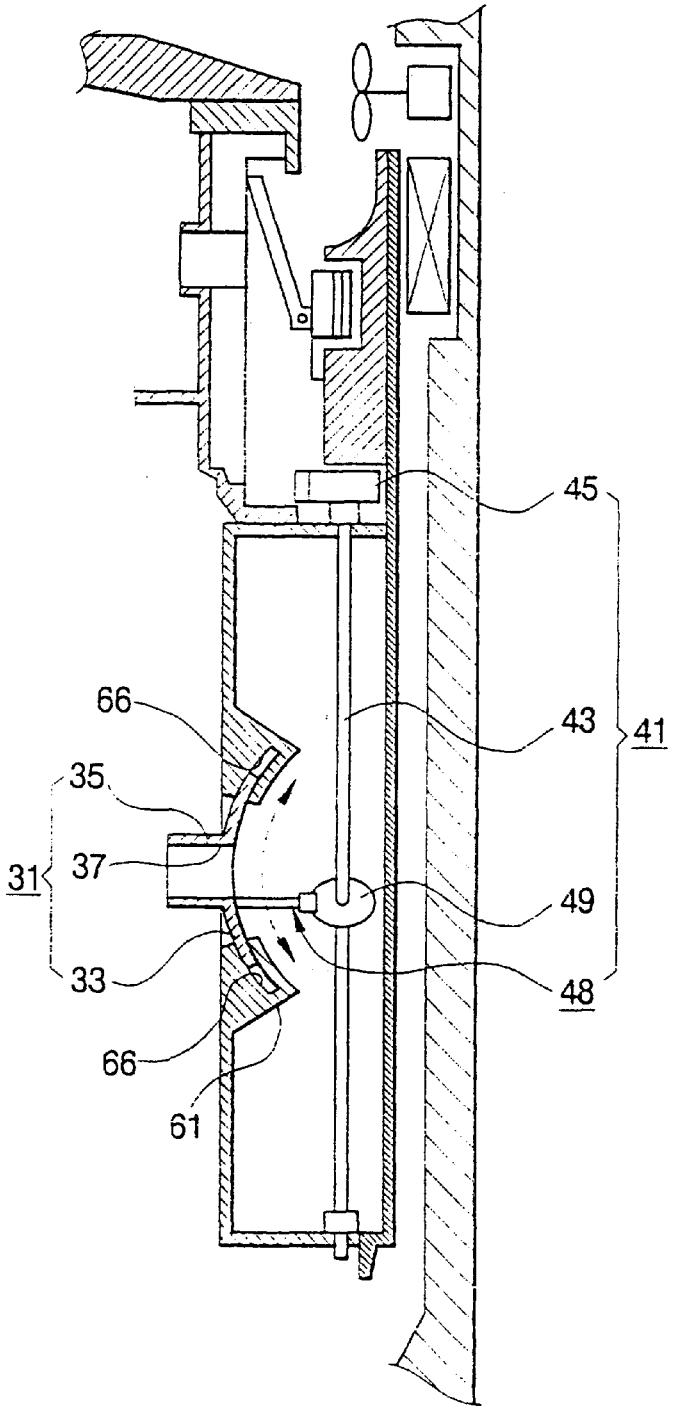
Figure 19:
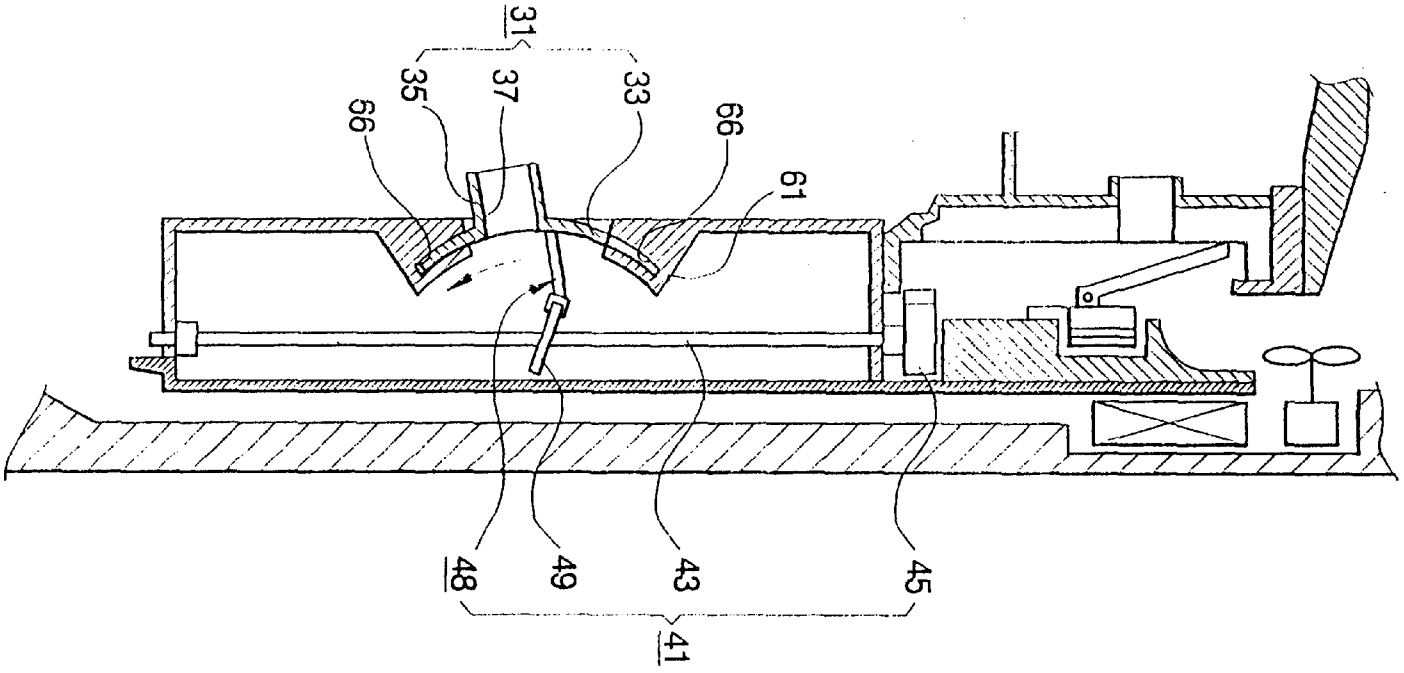

The motor 45 rotates the rotational shaft 43 according to the control of a microprocessor which is not shown. As the rotational shaft 43 is continuously rotated, the discharge member 31 is moved up and down by the cam 49 and the assembly part 48. FIGS. 17 through 19 show the state that the discharge member 31 is moved up, positioned in the middle, and moved down, respectively, by the cam 49 and the assembly part 48 while the rotational shaft 43 is rotating. As the rotational shaft 43 is rotated by the motor 45 continuously, the discharge direction of the cool air is consecutively changed by the discharge pipe 35. Therefore, the cool air is dispersed vertically.

Meanwhile, when the temperature of a specific area in the fresh food compartment 3 rises, a concentrative cooling of the specific area can be performed by controlling the rotational position of the rotational shaft 43. In other words, if a rise in temperature of a specific area in the fresh food compartment 3 is detected by a sensor which in not shown, the microprocessor (not shown) drives the motor 45 to stop the rotational shaft 43 on a rotational position corresponding to the specific area, whereby the discharge pipe 35 is tilted toward the specific area.

According to the present embodiment, a specific area of which temperature has risen in a short period of time is cooled in a concentrative manner, and thereby the temperature of the fresh food compartment 3 can be maintained uniform. In order to realize such a concentrative cooling, a stepping motor is preferably used as the motor 45, which is capable of controlling a stop angular position thereof.

As described above, according to the present invention, a refrigerator is provided which is simple and capable of preventing backflow of air from a cooling compartment to an evaporator. Furthermore, uniform distribution of cool air can be achieved in horizontal and vertical directions, and a user can control the discharge direction of cool air arbitrarily. In particular, if an additional driving device is employed, the uniform distribution of cool air can be realized more easily, and the concentrative cooling of a specific area can be performed automatically.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A refrigerator comprising:

a duct plate for forming a cool air duct in a side wall of said cooling compartment, said duct plate having an opening part opened into said cooling compartment;

a discharge member being installed on said duct plate so as to close said opening part, said discharge member having a discharge pipe for discharging cool air flowing to said cool air duct toward said cooling compartment; and a means for supporting said discharge member so that a position of said discharge pipe can be changed.

2. A refrigerator comprising:

a cooling compartment including a vertical wall;

a duct plate forming a cool air duct extending along the vertical wall for conducting cool air, the duct plate forming an air discharge opening; and a discharge member installed on the duct plate and extending across the air discharge opening, the discharge member including a discharge pipe having an inlet end communicating with the cool air duct for receiving cool air therefrom, and an outlet end communicating directly with the cooling chamber for supplying a cool air flow directly into the cooling chamber, the discharge member being supported for movement relative to the duct plate and the vertical wall, whereby a direction of the cool air flow within the cooling chamber can be changed.

3. The refrigerator as claimed in claim 2, further comprising a means for driving said discharge member so that the position of said discharge pipe is changed.

4. The refrigerator as claimed in claim 3, wherein said driving means comprises:

a motor;

a rotational shaft being rotated by said motor; and a means for converting a rotational movement of said rotational shaft to an elevational/de-elevational movement of said discharge member, whereby an angular position of said discharge pipe relative to a horiziontal plane can be discharged.

5. The refrigerator as claimed in claim 4, wherein said converting means comprises:

a cam being installed on said rotational shaft, said cam rotating together with said rotational shaft; and an operation part being formed on said discharge member, said operation part being elevated/de-elevated by said cam.

6. The refrigerator as claimed in claim 5, wherein said cam is a disc tilted at a predetermined angle against said rotational shaft.

7. The refrigerator as claimed in claim 4, wherein said motor is a stepping motor.

8. The refrigerator as claimed in claim 2 further including a guide part mounted in the air opening, the guide part including recesses for receiving respective edges of the discharge member to enable the edges to slide within the recesses.

9. The refrigerator as claimed in claim 8, wherein said recesses are formed vertically, whereby said discharge member is capable of sliding vertically.

10. The refrigerator as claimed in claim 8, wherein said recesses are formed horizontally, whereby said discharge member is capable of sliding horizontally.

11. The refrigerator as claimed in claim 8, wherein said recesses are curved to be arc-shaped, and said discharge member has a shape of a plate which is curved so as to correspond to said recesses, whereby an angular position of said discharge pipe relative to a horizontal plane can be changed.

12. The refrigerator as claimed in claim 2, wherein said recesses are curved to be arc-shaped, and said discharge member has a shape of a plate which is curved so as to correspond to said recesses, whereby an angular position of said discharge pipe relative to a vertical plane can be changed.

* * * * *